US012672714B2

(12) United States Patent
Holma

(10) Patent No.: US 12,672,714 B2
(45) Date of Patent: Jul. 7, 2026

(54) EXTENSION TABLE

(71) Applicant: Inter IKEA Systems B.V., Delft (NL)

(72) Inventor: Thomas Holma, Svängsta (SE)

(73) Assignee: Inter IKEA Systems B.V., Delft (NL)

( * ) Notice: Subject to any disclaimer, the term of this patent is extended or adjusted under 35 U.S.C. 154(b) by 0 days.

(21) Appl. No.: 17/635,748

(22) PCT Filed: Aug. 21, 2020

(86) PCT No.: PCT/SE2020/050807
§ 371 (c)(1),
(2) Date: Feb. 16, 2022

(87) PCT Pub. No.: WO2021/034262
PCT Pub. Date: Feb. 25, 2021

(65) Prior Publication Data

US 2022/0304460 A1 Sep. 29, 2022

(30) Foreign Application Priority Data

Aug. 21, 2019 (SE) ..... 1950954-6

(51) Int. Cl.
*A47B 1/10* (2006.01)
*A47B 1/02* (2006.01)
*A47B 1/08* (2006.01)

(52) U.S. Cl.
CPC ..... *A47B 1/10* (2013.01); *A47B 1/02* (2013.01); *A47B 1/08* (2013.01)

(58) Field of Classification Search
CPC ..... A47B 1/10; A47B 1/02; A47B 1/08
USPC ..... 108/65, 83
See application file for complete search history.

(56) References Cited

U.S. PATENT DOCUMENTS 984,244 A 2/1911 Shapiro
1,030,438 A * 6/1912 Tyden ..... A47B 1/08 108/83
1,243,621 A * 10/1917 Nelson ..... 108/67
(Continued)

FOREIGN PATENT DOCUMENTS

AU 31951/77 A 6/1979
CN 205903003 U 1/2017
(Continued)

OTHER PUBLICATIONS

PCT International Search Report for PCT Application No. PCT/SE2020/050807 mailed Sep. 30, 2020 (5 pages).
(Continued)

*Primary Examiner* — Daniel J Troy
*Assistant Examiner* — Timothy M Ayres
(74) *Attorney, Agent, or Firm* — Capitol City TechLaw

(57) ABSTRACT

An extension table (2) comprises a plurality of extension rails (4, 6) each extending along the table (2) for adjusting a dimension of the said table (2); an extension leaf (14); and a locking mechanism, comprising a first locking part (16) fixed to an extension rail (4) of the said plurality of extension rails (4, 6); and a second locking part (18) fixed to the extension leaf (14); wherein the first locking part (16) is lockable to the second locking part (18), when the extension leaf (14) is added to the extension table (2), so that the extension leaf (14) is prevented from being lifted upwards.

11 Claims, 8 Drawing Sheets

(56) References Cited

U.S. PATENT DOCUMENTS 1,355,669 A * 10/1920 Henry ..... A47C 7/26 297/440.22
1,378,878 A * 5/1921 Larson ..... A47B 1/08 108/83
1,479,805 A * 1/1924 Gutridge ..... A47B 1/02 108/85
1,729,221 A * 9/1929 Krema ..... A47B 1/02 108/63
2,092,244 A * 9/1937 Charak ..... A47B 1/04 108/77
2,511,282 A 6/1950 McFall
2,629,642 A * 2/1953 Whallon ..... A47B 1/10 384/17
2,676,858 A * 4/1954 Duncan ..... A47B 1/02 108/83
2,829,018 A * 4/1958 Valtri ..... A47B 1/10 52/582.2
3,313,510 A * 4/1967 Mudano ..... A47B 1/02 108/83
4,266,882 A * 5/1981 Wilhelmi ..... A47B 87/002 403/14
4,481,702 A * 11/1984 Mitchell ..... F16B 13/066 29/432
4,490,064 A * 12/1984 Ducharme ..... F16B 7/0466 403/255
4,530,136 A * 7/1985 Konkle ..... A47B 87/002 24/453
5,927,212 A * 7/1999 Huang ..... A47B 1/02 108/86
6,742,461 B1 * 6/2004 Sen ..... A47B 1/02 108/86
7,708,252 B2 * 5/2010 Vander Berg ..... A47G 1/1606 248/475.1
9,622,568 B1 * 4/2017 Lin ..... A47B 13/081
9,675,169 B1 * 6/2017 Lai ..... A47B 1/05
10,130,174 B2 * 11/2018 Perrin ..... B23Q 1/58
11,096,479 B2 * 8/2021 Mansson ..... A47C 17/76
11,344,112 B1 * 5/2022 Chen ..... A47B 3/0918
2018/0344023 A1 * 12/2018 Andersson ..... A47B 1/08
2022/0183459 A1 * 6/2022 Andersson ..... A47B 1/10
2022/0287450 A1 * 9/2022 Benard ..... A47B 1/10
2022/0338615 A1 * 10/2022 Andersson ..... A47B 1/02

FOREIGN PATENT DOCUMENTS

CN 207011932 U 2/2018
CN 113766855 A 12/2021
EP 2815678 A1 12/2014
EP 3952699 A1 2/2022
IT 201600127788 A1 6/2018

OTHER PUBLICATIONS

PCT Written Opinion PCT Application No. PCT/SE2020/050807 mailed Sep. 30, 2020 (6 pages).
Chinese Office Action dated Sep. 1, 2023 for corresponding Chinese Patent Application No. 202080058327.8 (7 pages).
Extended European Search Report dated Jan. 8, 2023 for corresponding European Application No. 20854744.8 (7 pages).

* cited by examiner

EXTENSION TABLE

This application is a National Stage Application of PCT/SE2020/050807, filed 21 Aug. 2020, which claims benefit of Serial No. 1950954-6, filed 21 Aug. 2019 in Sweden, and which applications are hereby incorporated by reference in their entireties. To the extent appropriate, a claim of priority is made to each of the above disclosed applications.

FIELD OF THE INVENTION

The present inventive concept relates to an extension table.

BACKGROUND

Extension tables are tables for which one lateral dimension can be adjusted by adding or removing one or more extension leaves. They are appreciated as pieces of furniture, since they provide flexibility in the home or office. There is always a need to improve the functioning of extension tables.

SUMMARY

To this end, according to the present inventive concept, there is provided an extension table, comprising a plurality of extension rails each extending along the table for adjusting a dimension of the said table; an extension leaf; and a locking mechanism, comprising a first locking part fixed to an extension rail of the said plurality of extension rails; and a second part fixed to the extension leaf; wherein the first locking part is lockable to the second locking part, when the extension leaf is added to the extension table, so that the extension leaf is prevented from being lifted upwards.

Preventing the extension leaf from being lifted improves the safety of using the extension table by improving the structural integrity of the same. This is especially the case when using several extension leaves, since the extension leaf is tied to the extension rail and not only, for example, to the other extension leaves, which otherwise could result in the extension leaves folding against each other.

The first locking part may comprise a first tab extending from the extension rail and the second locking part may comprise a second tab being configured to slide under the first tab when the extension leaf is added to the extension table.

This provides a simple, yet robust, locking mechanism.

The first tab may be horizontal and the second tab may be parallel to a main surface of the extension leaf.

This allows one to add an extension leaf by horizontally sliding it in place, which is straightforward and easy to perform for the user.

The first locking part may have an "L" shape, with a first part of the "L" abutting and being fixed to the extension rail and a second part of the "L" extending transversally with respect to the extension rail. The first locking part may comprise a protrusion extending into a matching hole in the extension rail. The first locking part may be riveted to the extension rail.

These features allow for a rigid first locking part that still is easy to manufacture.

The second locking part may comprise a spacing part abutting and being fixed to an underside of the extension leaf and the second tab extends from the spacing part.

This allows for a rigid second locking part that still is easy to manufacture.

The spacing part may have a hollow interior. This saves material.

The first tab and the second tab may have matching knurled surfaces. This prevents the first locking part from sliding with respect to the second locking part, improving the functioning of the locking mechanism.

The first locking part and the second locking part may be made of plastic.

The extension rail may be made of metal, which may be bent sheet metal.

BRIEF DESCRIPTION OF THE DRAWINGS

The above, as well as additional objects, features and advantages of the present inventive concept, will be better understood through the following illustrative and non-limiting detailed description of preferred embodiments, with reference to the appended drawings, where the same reference numerals will be used for similar elements, wherein.

DETAILED DESCRIPTION

Figure 1:
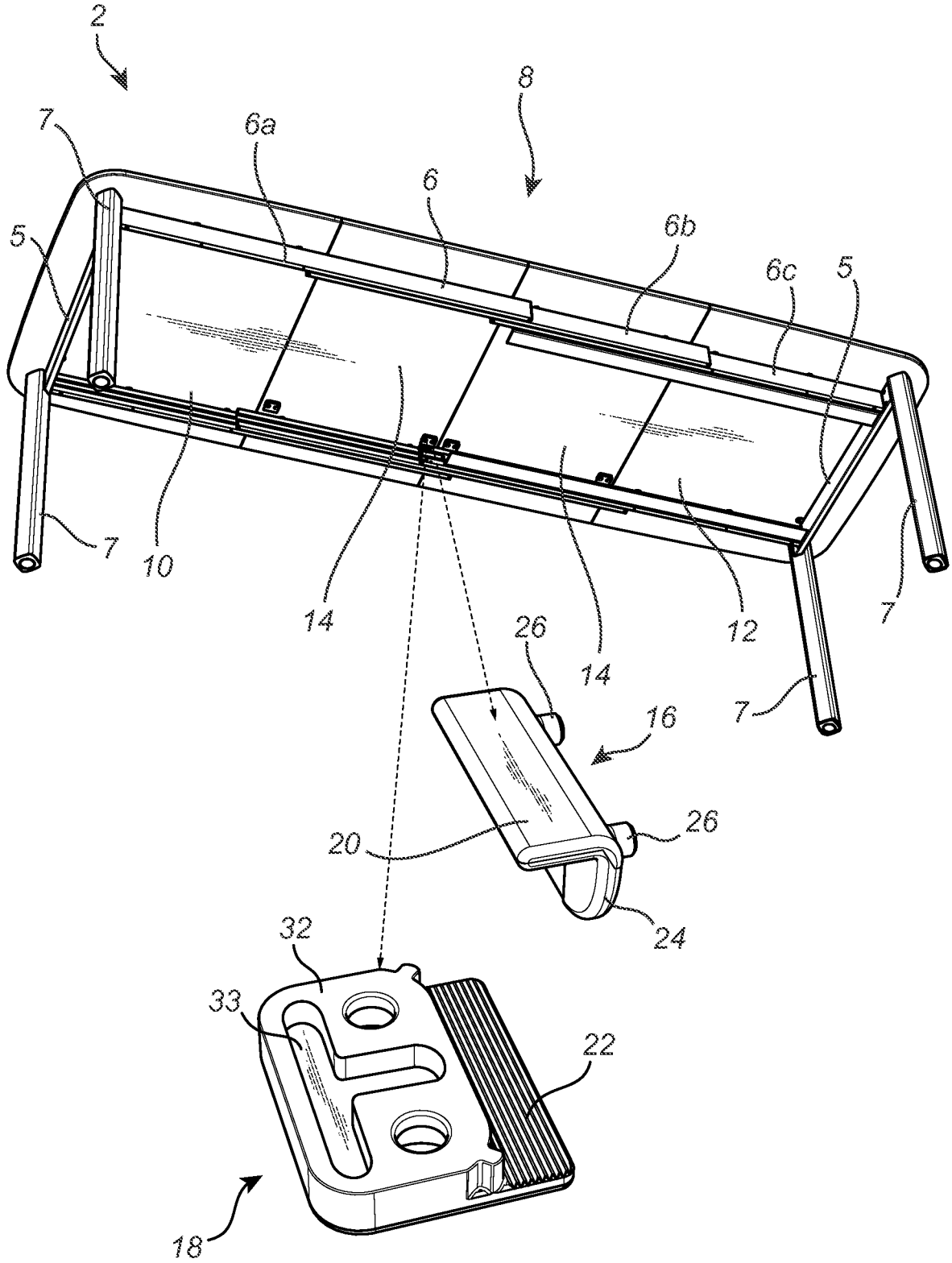
FIG. 1 shows a perspective view of an extension table with close-ups of a first and a second part of a locking mechanism.

FIG. 1 shows an extension table 2.

The extension table 2 comprises a first extension rail 4 and a second extension rail 6, each extending along the length of the table 2 for adjusting the length of the table 2. Each extension rail 4, 6 may comprise two or more parts—as depicted three parts 6*a*, 6*b*, 6*c*— slidable against each other for adjusting the length of the extension rails 4, 6, and thus of the table 4. Each of the extension rails 4, 6 may be made of metal, which may be bent sheet metal.

The extension rails are at each end connected to each of two rigid short sections 5, so that each of the short sections 5 and the first extension rail 4 and the second extension rail 6 form a rectangular frame on which the tabletop 8 rests. At each of the four corners of the frame, a respective table leg 7 is attached.

The tabletop 8 of the table 2 is formed by a first fixed part 10 at a first short end of the table 4, a second fixed part 12 at a second short end of the table 4, and, optionally at the point of use, one or more extension leaves 14—as depicted two extension leaves 14—positionable to rest on the first 4 and second 6 extension rails between the first fixed part 10 and the second fixed part 12.

Further, the extension table 2 comprises a locking mechanism comprising a first locking part 16 attached to the first extension rail 4 and a second locking part 18 attached to an extension leaf 14, as will be elaborated upon in the following.

Figure 2:
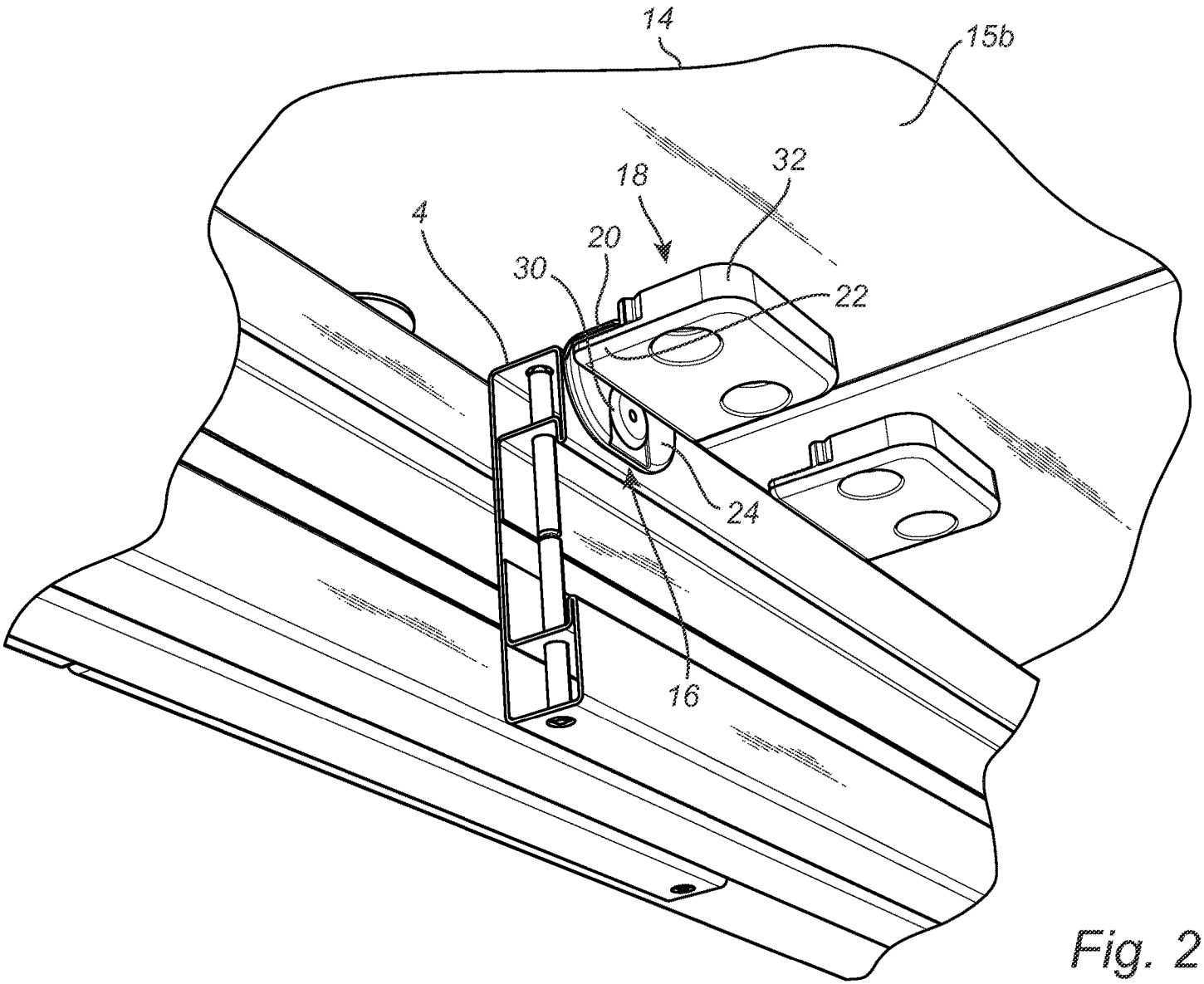
FIGS. 2 and 3 show, respectively, in a perspective view and in a cross-sectional view, the first and the second part of the locking mechanism, as installed.
Figure 3:
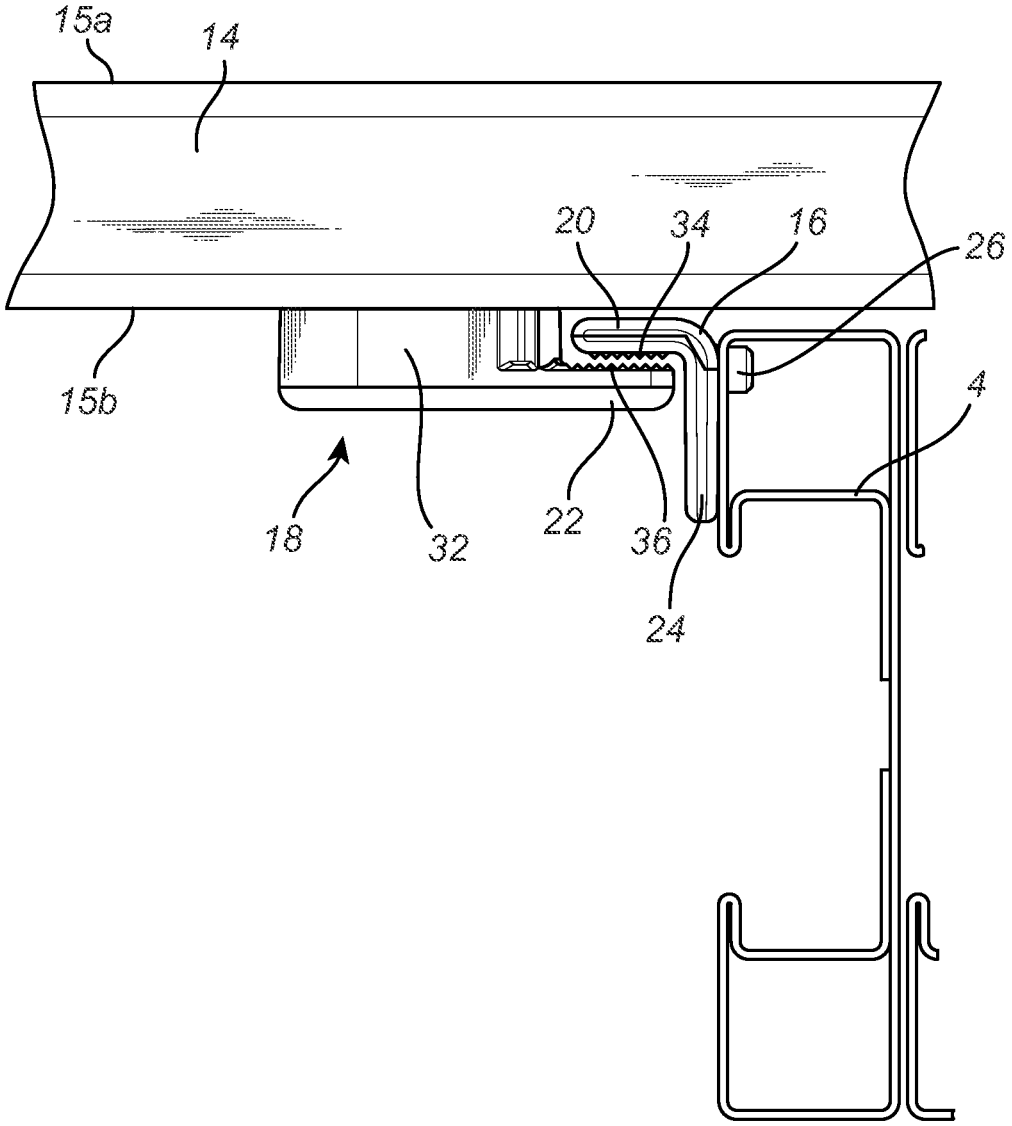
Figure 4:
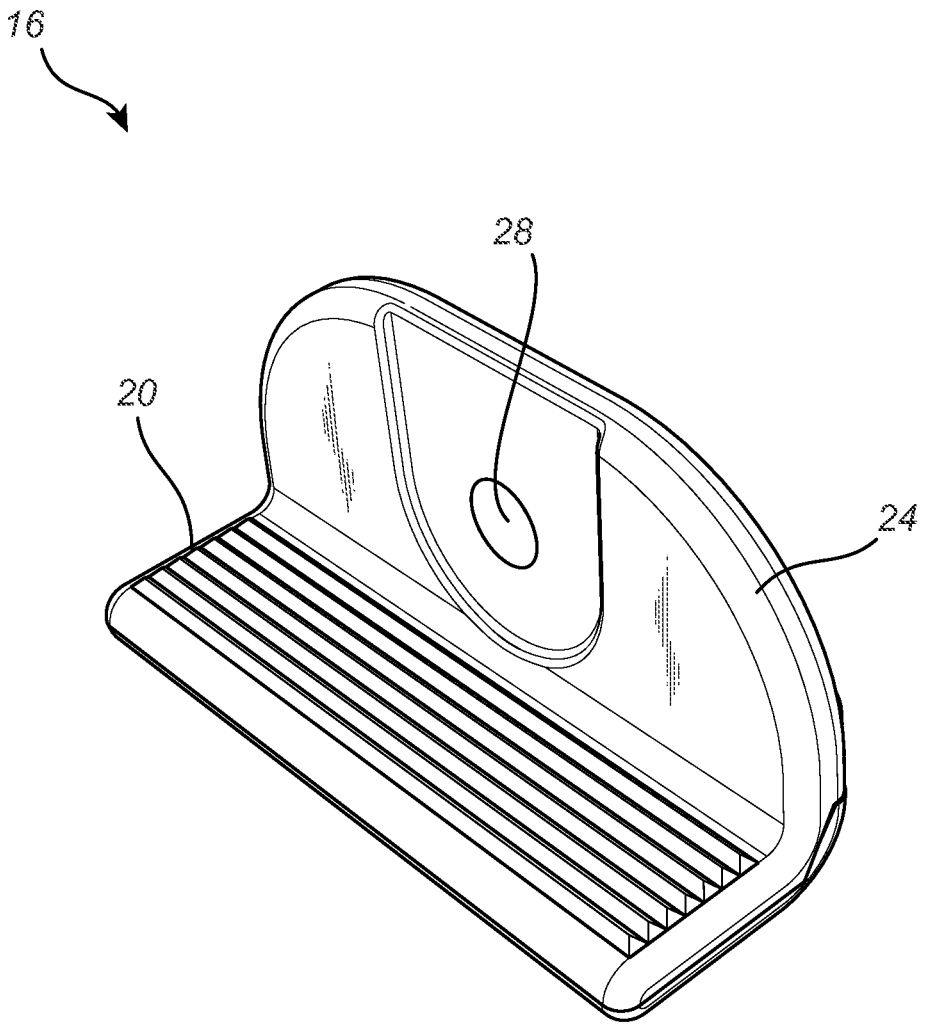
FIG. 4 shows, in a perspective view, an isolated close-up of the first part of the locking mechanism.

FIGS. 1 and 4 show the first locking part 16 isolated, FIG. 1 shows the second locking part 18 isolated, while FIGS. 2 and 3 show the locking mechanism as installed with the first locking part 16 attached to the first extension rail 4 and the second locking part 18 attached to the extension leaf 14.

The first locking part 16 has an "L" shape with a first part 24 of the "L", as installed, abutting the first extension rail 4 and a second part of the "L" in the form of a first, horizontal, tab 20, as installed extending transversally from the first extension rail 4.

The first locking part 16 may be made of plastic.

The first part 24 of the "L" may be attached to the first extension rail 4 through a rivet 30 through a hole 28 in the first part 24 of the "L". Further, the first part 24 of the "L" comprises two protrusions 26 extending into a respective matching holes in the first extension rail 4, for keeping the first locking part 16 in place with respect to the first extension rail 4.

The second locking part 18 comprises a spacing part 32 abutting and being fixed to the underside of one of the extension leafs 14, and a second tab 22 extending from the spacing part 32, parallel to the upper 15*a* and lower 15*b* main surfaces of the extension leaf 14, thus extending horizontally in installed position. The spacing part 32 may have a hollow interior 33.

The second locking part 18 may be made of plastic.

Through this arrangement, if one were to attempt lifting the extension leaf 14 upwards in the vicinity of the locking mechanism, away from the first extension rail 4, the second tab 22 of the second locking part 18 will be blocked by the first tab 20 of the first locking part 16. Thereby, the extension leaf 14 is prevented from being lifted upwards.

As shown in FIG. 3, the first tab 20 may have a first knurled surface 34, which grooves along the direction of movement as will be described below with reference to FIGS. 5A-5D, matching a second knurled surface 32, with grooves in the same direction as for the first knurled surface 32, on the second tab 22.

FIGS. 5A-5D shows addition of an extension leaf 14 to the extension table 2.

Figure 5A:
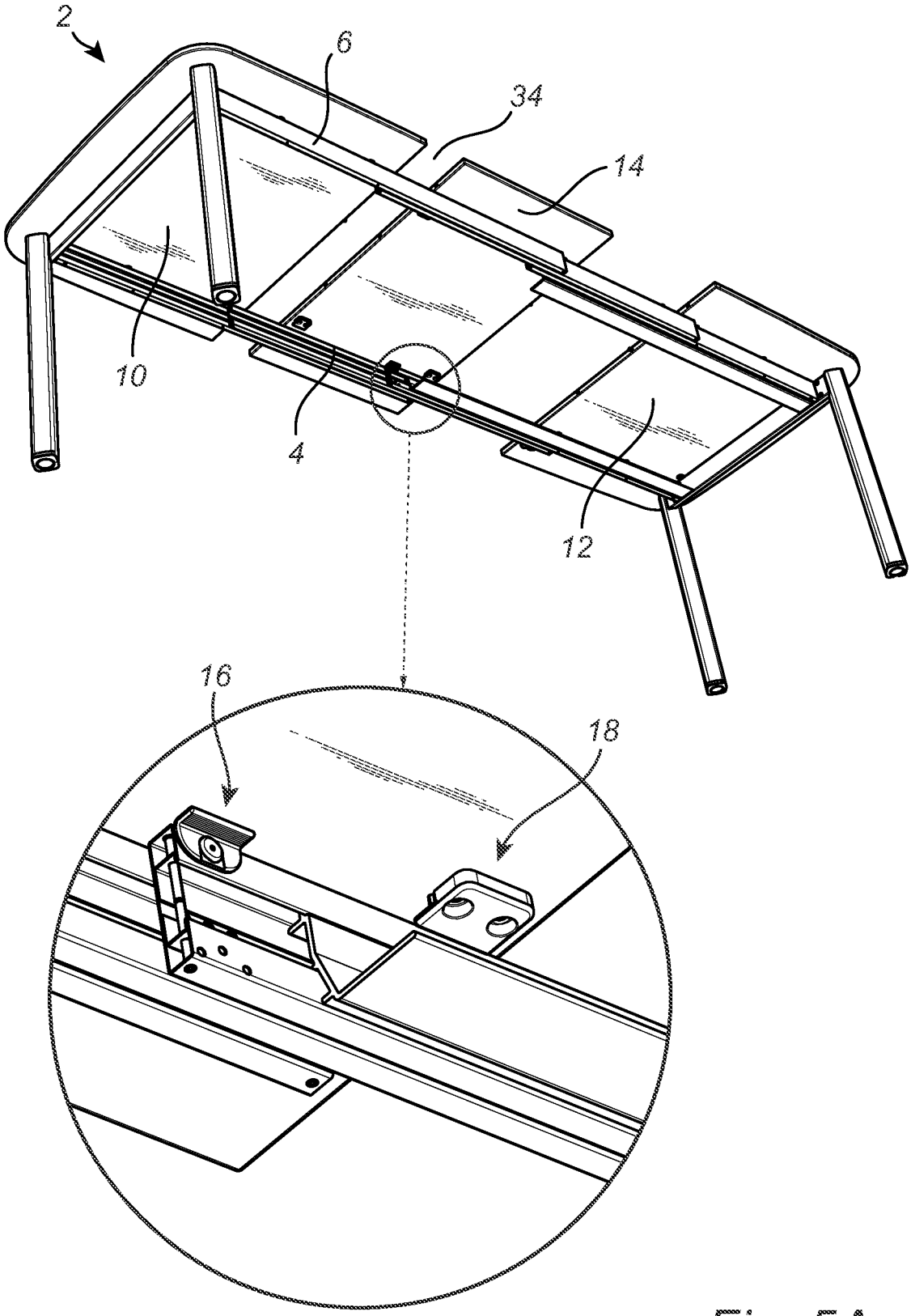
FIGS. 5A, 5B, 5C, and 5D show addition of an extension leaf to the extension table.

First, with reference to FIG. 5A, the first fixed part 10 and the second fixed part 12 may be pulled apart by extending the first extension rail 4 and the second extension rail 6, forming a space 34 between the first fixed part 10 and the second fixed part 12.

Then, still with reference to FIG. 5A, the extension leaf 14 may be placed in the space 34, resting on the first extension rail 4 and the second extension rail 6. At this point, the first locking part 16 is not aligned with the second locking part 18.

Figure 5B:
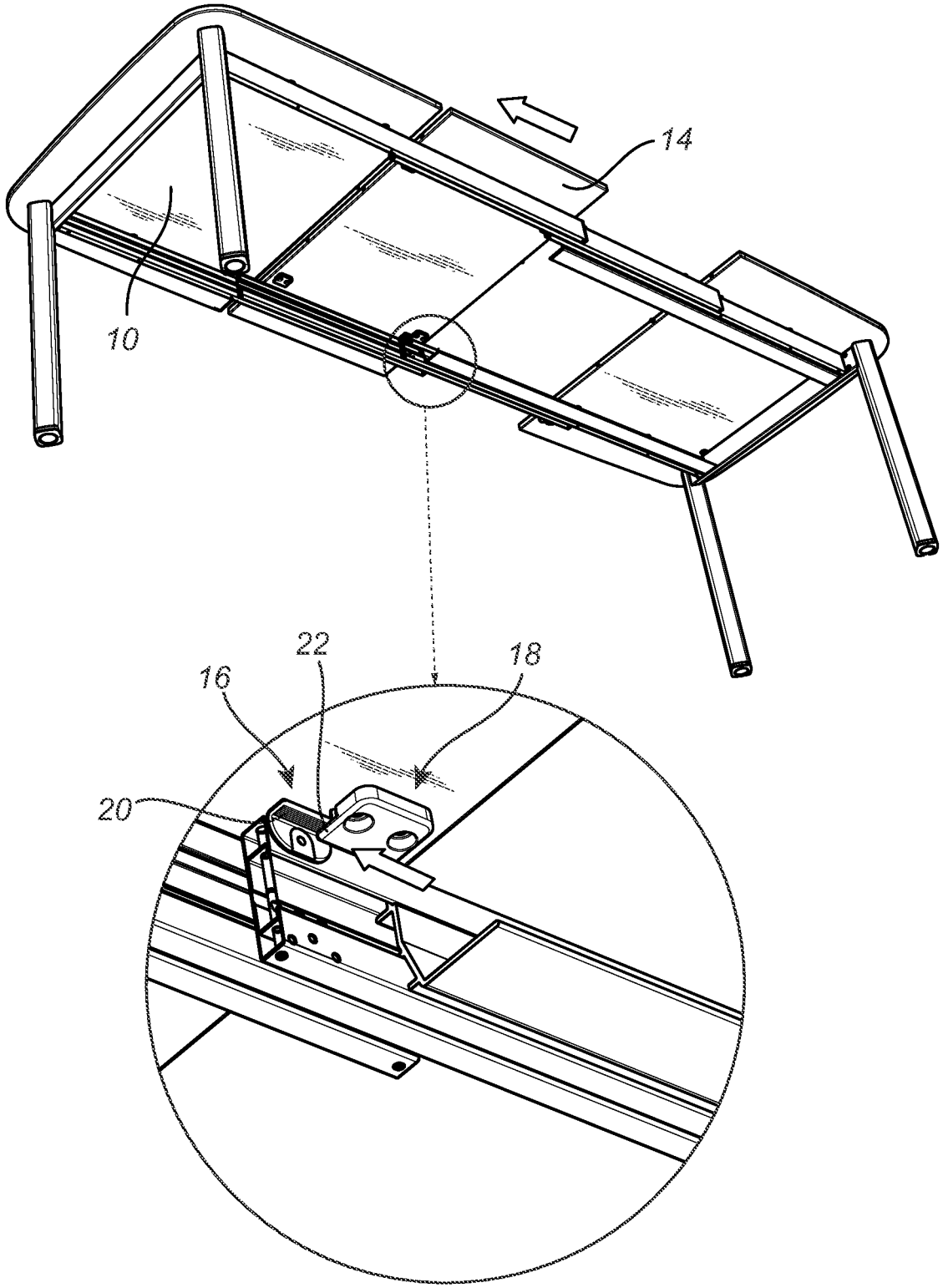

Then, with reference to FIG. 5B, the extension leaf 14 is slid horizontally towards the first fixed part 10, as indicated by arrows. During this movement, the second tab 22 of the second locking part 18 slides under the first tab 20 of the first locking part 16.

The second extension rail may have a first locking part locking to an additional second locking part of the extension leaf according to the same principle as just described.

Figure 5C:
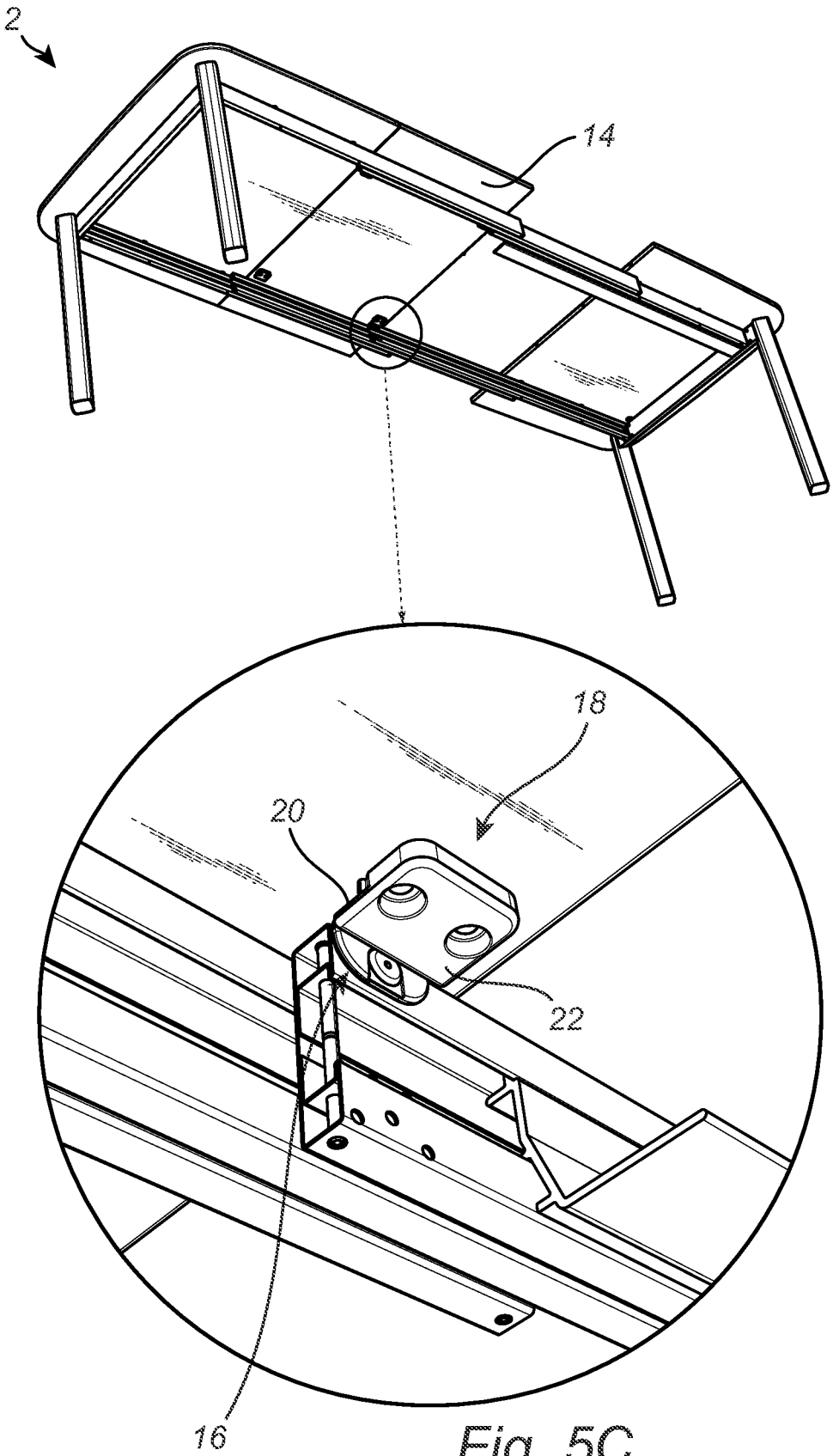

Then, at the end of this movement, as shown in FIG. 5C, the second tab 22 of the second locking part 18 is located below the first tab 20 of the first locking part 16.

Figure 5D:
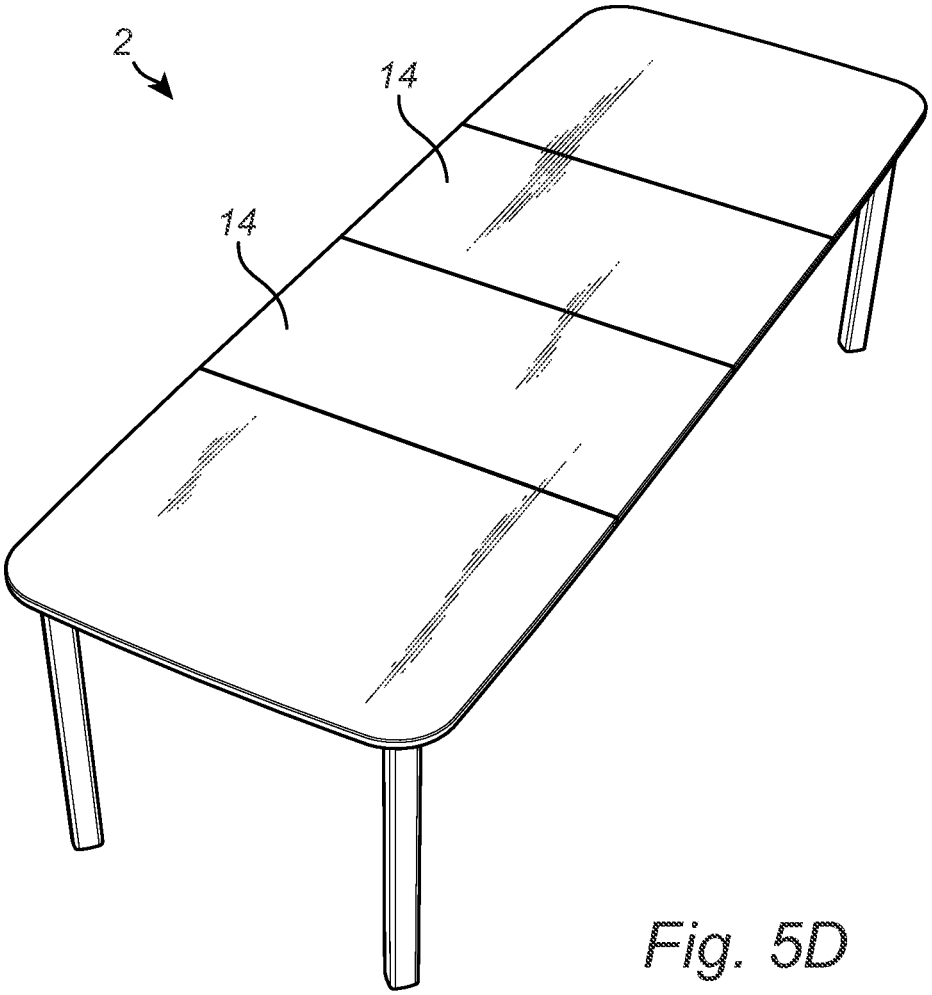

Then, with reference to FIG. 5D, optionally, a second extension leaf 14 may be added, optionally, according to the same principle with corresponding additional locking mechanisms as previously described.

Thus, as has been described in the preceding, the extension table 2 comprises a locking mechanism, comprising a first part 16 fixed to an extension rail 4 of a plurality of extension rails 4, 6; and a second part 18 fixed to an extension leaf 14; wherein the first part 16 is lockable to the second part 18, when the extension leaf 14 is added to the extension table 2, so that the extension leaf 14 is prevented from being lifted upwards.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

The invention claimed is:

1. An extension table, comprising:

a first extension rail and a second extension rail each extending along the table for adjusting a dimension of the table, each of the extension rails including an outer rail part and an inner rail part that are slidable relative to each other;

a first fixed part fixed to the outer rail parts of the extension rails, and a second fixed part fixed to the inner rail parts of the extension rails;

an extension leaf that is removably attachable to the extension rails between the first and the second fixed parts; and a locking mechanism, including:

two first locking parts, one of the first locking parts fixed to the inner rail part of the first extension rail, and another of the first locking parts fixed to the inner rail part of the second extension rail, each of the two first locking parts including a first tab extending from one of the extension rails; and two second locking parts fixed to the extension leaf, each of the two second locking parts including a second tab;

wherein the two first locking parts are mounted on inward facing sides of the inner rail parts of the extension rails, such that the first tabs extend inward from the inner rail parts;

wherein the first locking parts are lockable to the second locking parts by placing the extension leaf on the extension rails, and sliding the extension leaf horizontally along the extension rails towards the first fixed part and at least one leg of the extension table, such that the second tabs slide under the first tabs, respectively, to prevent the extension leaf from being lifted upwards; and wherein the second tabs are fixed and do not move relative to the extension leaf.

2. The extension table of claim 1, wherein the first tabs are horizontal and the second tabs are parallel to a main surface of the extension leaf.

3. The extension table of claim 1, wherein each of the first locking parts has an "L" shape, with a first part of the "L" abutting and being fixed to the corresponding extension rail and a second part of the "L" extending transversally with respect to the extension rail.

4. The extension table of claim 1, wherein each of the first locking parts comprises a protrusion extending into a matching hole in the corresponding extension rail.

5. The extension table of claim 1, wherein each of the first locking parts is riveted to the corresponding extension rail.

6. The extension table of claim 1, wherein each of the second locking parts comprises a spacing part abutting and being fixed to an underside of the extension leaf and the second tab extends from the spacing part.

7. The extension table of claim 6, wherein the spacing parts have a hollow interior.

8. The extension table of claim 1, wherein the first tabs and the second tabs have matching knurled surfaces.

9. The extension table of claim 1, wherein the first locking parts and the second locking parts are made of plastic.

10. The extension table of claim 1, wherein the plurality of extension rails are made of metal.

11. The extension table of claim 1, wherein the first fixed part of the extension table is a fixed horizontal part of the extension table.

* * * * *